US006934973B2

(12) United States Patent
Lehmann et al.

(10) Patent No.: US 6,934,973 B2
(45) Date of Patent: Aug. 30, 2005

(54) DISPENSING DEVICE FOR DISPENSING AN ACTIVE-SUBSTANCE FLUID INTO THE FLUSHING LIQUID IN A TOILET BOWL

(75) Inventors: Detlef Lehmann, Erkrath (DE); Lutz Graesser, Stolberg (DE); Hans-Georg Muehlhausen, Duesseldorf (DE); Ronald Menke, Mettmann (DE); Frank Pessel, Duesseldorf (DE); Ralph Butter-Jentsch, Langenfeld (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/910,678

(22) Filed: Aug. 3, 2004

(65) Prior Publication Data

US 2005/0028257 A1 Feb. 10, 2005

Related U.S. Application Data

(63) Continuation of application No. PCT/EP03/00863, filed on Jan. 29, 2003.

(30) Foreign Application Priority Data

Feb. 7, 2002 (DE) ..... 102 04 928

(51) Int. Cl.[7] ..... E03D 9/02
(52) U.S. Cl. ..... 4/231; 4/223
(58) Field of Search ..... 4/231, 223, 227.1, 4/227.4–227.6, 224, 230; 222/156, 157, 88, 90

(56) References Cited

U.S. PATENT DOCUMENTS

| | | | | |
|---|---|---|---|---|
| 3,964,448 A | | 6/1976 | Sioufy | |
| 4,096,593 A | | 6/1978 | Vlahakis | |
| 4,813,084 A | | 3/1989 | Buecheler et al. | |
| 5,955,415 A | | 9/1999 | Gutierrez et al. | |
| 6,178,564 B1 | * | 1/2001 | Leonard et al. | 4/223 |
| 6,230,334 B1 | | 5/2001 | Camp et al. | |
| 6,389,610 B1 | | 5/2002 | Hautmann et al. | |
| 6,505,356 B1 | * | 1/2003 | Leonard et al. | 4/231 |
| 6,651,261 B1 | * | 11/2003 | Leonard et al. | 4/231 |
| 6,675,396 B2 | * | 1/2004 | Varanasi et al. | 4/223 |
| 2004/0068782 A1 | | 4/2004 | Butter-Jentsch et al. | |
| 2004/0088781 A1 | | 5/2004 | Suffa | |
| 2004/0107484 A1 | | 6/2004 | Butter-Jentsch et al. | |

FOREIGN PATENT DOCUMENTS

| | | |
|---|---|---|
| DE | 1164141 | 9/1969 |
| DE | 2 225 161 | 8/1973 |
| DE | 30 02 833 A1 | 7/1981 |

(Continued)

OTHER PUBLICATIONS

Claims of U.S. Appl. No. 10/416,655 pending as of May 14, 2003.

Claims of U.S. Appl. No. 10/416,681 pending as of Aug. 25, 2004.

*Primary Examiner*—Khoa D. Huynh
(74) *Attorney, Agent, or Firm*—Stephen D. Harper; Glenn E. J. Murphy

(57) ABSTRACT

A dispensing device for dispensing fluids into toilet flushing liquids. The device has a supply container for an active-substance fluid, the supply container having an outlet-side border, an outlet for dispensing active-substance fluid onto a plate-shaped distributing element. The distributing element has a region of action over which flushing liquid flows during the flushing and a connection region, in which the outlet opening of the supply container is arranged. The border is spaced a small distance from the surface of the distributing element. On the top of the distributing element, on the point of connection and directed away from the region of action, is a ventilating channel that is open on top and closed on three sides at its inner end.

31 Claims, 3 Drawing Sheets

FOREIGN PATENT DOCUMENTS

Figure 1:
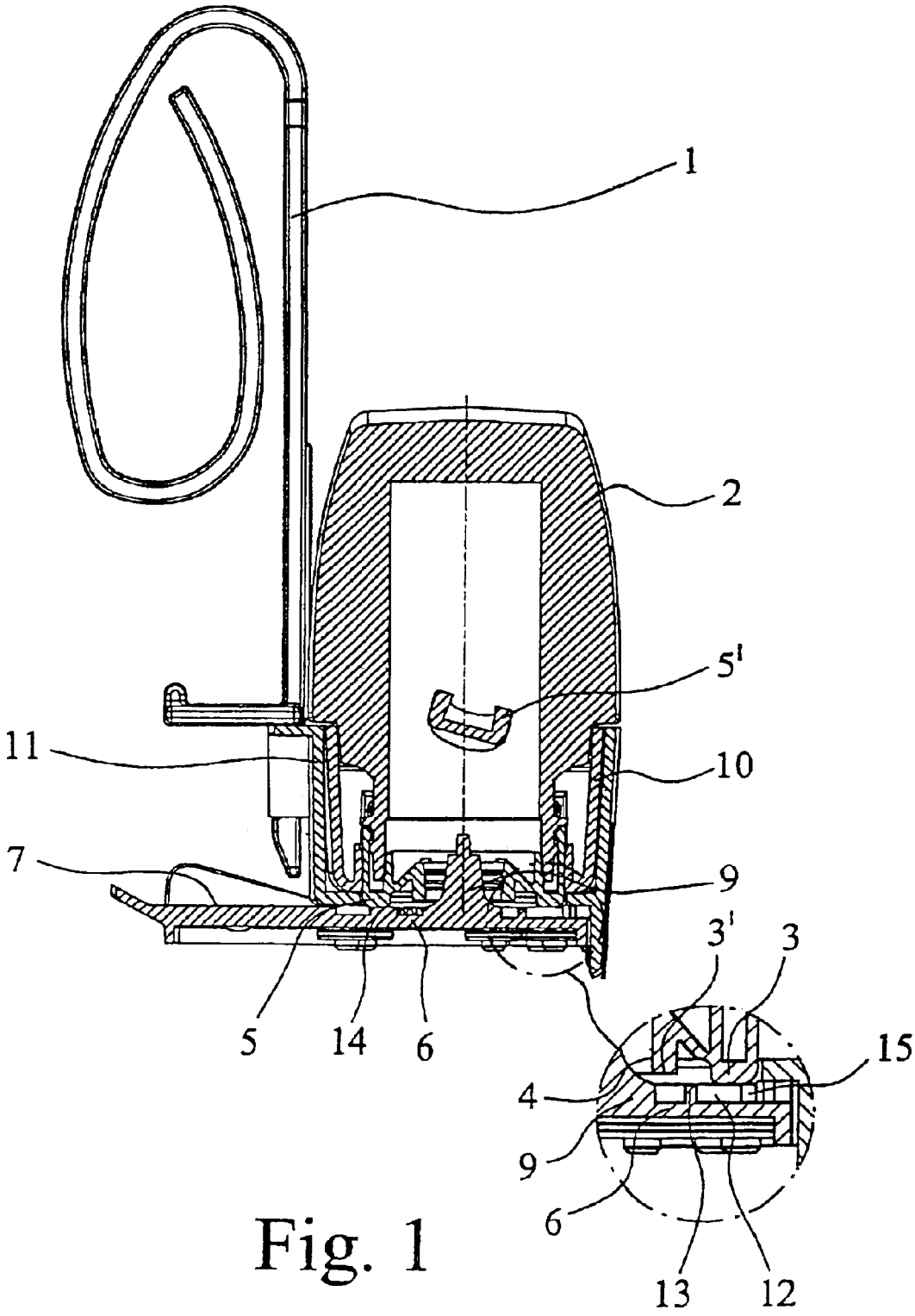

| | | | |
|---|---|---|---|
| DE | 34 19 169 | A1 | 11/1985 |
| DE | 299 02 066 | U1 | 6/1999 |
| DE | 199 15 322 | C1 | 1/2001 |
| DE | 201 16 963 | U1 | 5/2002 |
| DE | 102 05 299 | A1 | 9/2002 |
| DE | 199 12 217 | C2 | 9/2002 |
| DE | 199 30 362 | C2 | 11/2003 |
| EP | 0 341 035 | A1 | 11/1989 |
| EP | 0 538 957 | B1 | 3/1992 |
| EP | 0 775 741 | A1 | 5/1997 |
| EP | 0 960 984 | A2 | 12/1999 |
| EP | 0 785 315 | B1 | 6/2000 |
| EP | 1 026 331 | A1 | 8/2000 |
| EP | 0 878 586 | B1 | 3/2004 |
| FR | 2 593 470 | | 7/1987 |
| GB | 464648 | | 4/1937 |
| GB | 2 338 496 | A1 | 2/1975 |
| GB | 2 024 017 | A | 1/1980 |
| GB | 2 098 253 | A | 11/1982 |
| WO | WO 93/16242 | | 8/1983 |
| WO | WO 92/20876 | A1 | 11/1992 |
| WO | WO 96/38367 | | 5/1996 |
| WO | WO 99/66139 | A1 | 12/1999 |
| WO | WO 99/66140 | A1 | 12/1999 |
| WO | WO 01/144591 | A1 | 6/2001 |
| WO | WO 02/064898 | A1 | 8/2002 |

* cited by examiner

DISPENSING DEVICE FOR DISPENSING AN ACTIVE-SUBSTANCE FLUID INTO THE FLUSHING LIQUID IN A TOILET BOWL

CROSS REFERENCE TO RELATED APPLICATIONS

This application is a continuation under 35 U.S.C. §365 (c) and 35 U.S.C. §120 of international application PCT/EP03/00863, filed Jan. 29, 2003, and claims priority under 35 U.S.C. §119 of DE 102 04 928.9, filed Feb. 7, 2002, both of which are incorporated herein by reference in their entirety.

BACKGROUND OF THE INVENTION

The invention relates to a dispensing device for dispensing an active-substance fluid into the flushing liquid in a toilet bowl. The term active-substance fluid denotes free-flowing, that is to say liquid to viscous active-substance preparations, possibly ones which are gel-like or also paste-like or granular or pourable in some other way, with cleaning, disinfecting, deodorizing, bleaching and similar actions (described, in particular, in DE 199 30 362 A1, and in EP 0 775 741 A1 and EP 0 960 984 A2).

Various configurations of dispensing devices of the type in question in the form of basket-like WC units are known. In the first place, dispensing devices for a single active-substance fluid are known. The active-substance fluid is located there in a supply container which is arranged firmly, or inserted in an exchangeable manner, in a holder and has an outlet opening arranged on the base side when the supply container is fitted on the holder.

In the case of a first known dispensing device for a single active-substance fluid, the active-substance fluid is added via an actuating element which can be impregnated therewith and can be exposed to the action of the flushing liquid (e.g. an actuating element made of an open-cell foam) (EP 785 315 A1). In this case, the outlet opening of the supply container, once a closure part of the supply container has been pushed out, is largely closed by a sealing element arranged in a stationary manner on the holder, with the result that just a flow path of small cross section is available in order for the active-substance fluid to trickle out. The device functions by utilizing the capillary action of the open-cell foam.

A dispensing device which is similar to the dispensing device explained above and has as ribbed plate serving for distributing the active-substance fluid in the flushing liquid is also known (DE 199 12 217 A1; WO 99/66140 A). In the case of this design, the supply container has an outlet opening which is enclosed by an annular border and via which the active-substance fluid can be dispensed into the flushing liquid. A plate-like distributing element is provided on the holder, this distributing element, on the one hand, having a region of action over which flushing liquid flows during the flushing operation and, on the other hand, a connection region, in which a piercing spike is arranged. The interior of the supply container is connected permanently to the distributing element via the outlet opening, with the interposition of the opening spike with lateral ribs, which prevents free flowing active-substance fluid. For this purpose, the border of the outlet opening is spaced apart by a small distance from the surface of the distributing element. A spacer arrangement is provided in order to realize this distance, the spacer arrangement having parallel ribs which form depressions between them. These depressions extend from the connection region into the region of action, as far as the opposite border, and serve, in the region of action, for distributing the active-substance fluid into the flushing liquid.

A further such dispensing device is described in the international publication WO 01/44591 A1. In the case of this design, the distributing element has on the top side, on that side of the point of connection which is directed away from the region of action, a ventilating channel which extends through beneath the border from the longitudinal border of the distributing element and is open on the top side.

GB 2 338 496 A describes a dispensing device which is ventilated by an additional valve. Different variants are illustrated for the functioning of this valve, but the valve opening is arranged separately from the outlet opening.

In the case of all the dispensing devices which are known from the prior art, provision has to be made for the active-substance fluid which passes out of the supply container somehow to be replaced by air flowing into the supply container. Ventilating channels which extend beneath the outlet opening of the supply container are regularly realized in the prior art. This results in a dynamic interaction of viscous active-substance fluid and air, as a result of which the exchange of air is ensured.

The teaching is based on the problem of optimizing the known dispensing device, for dispensing active-substance fluids, in respect of possible control of the operation of dispensing the active-substance fluid. The basic elements of known dispensing devices for dispensing an active-substance fluid into the flushing liquid in a toilet bowl include a supply container (2) for an active-substance fluid, the supply container (2) having an outlet-side border (3) and an outlet opening (4) via which the active-substance fluid can be dispensed into the flushing liquid. A plate-like distributing element (6) is provided, this having, on the one hand, a region of action (7) over which flushing liquid flows during the flushing operation and, on the other hand, a connection region (8), in which a point of connection (9) for the outlet opening (4) of the supply container (2) is arranged. The interior of the supply container (2) is connected permanently to the distributing element (6) via the outlet opening (4), and that, for this purpose, the border (3) is spaced apart by a small distance from the surface of the distributing element (6). Arranged on the top side of the distributing element (6), on that side of the point of connection (9) which is directed away from the region of action (7), is a ventilating channel (12) which extends through beneath the border (3) from the longitudinal border of the distributing element (6) and is open on the top side.

SUMMARY OF THE INVENTION

The problem presented above is solved, in the case of a dispensing device having the features just described by closing the border of the ventilating channel (12) at its inner end. In the prior art, the ventilating channel has its border open at the inner end. The connection region located beneath the outlet opening of the supply container thus opens laterally, on the one hand, in the direction of the region of action and, on the other hand, toward the ventilating channel. This gives rise to the classic, dynamic interaction of the viscous active-substance fluid and air for the purpose of the active-substance fluid/air exchange. According to the invention, it has been found that it is possible to optimize this typical exchange of air, which has been known for decades, via a ventilating channel on the top side of the distributing element by virtue of the ventilating channel being closed laterally at the inner end. The air supply via the ventilating channel is thus deflected upward in the critical region in the vicinity of the outlet opening. This corresponds to the direction in which the air rises into the supply container. The smallest possible resistance is set against the access of air into the supply container. At the same time, surprisingly, active-substance fluid is prevented from entering into the ventilating channel because any kind of capillary effect is suppressed, or at any rate reduced, by the end of the ventilating channel being closed. The active-substance fluid itself serves for sealing the ventilating channel, but allows the access of air via the ventilating channel. The active-substance fluid is itself dispensed in the opposite direction, toward the region of action.

Moreover, as a result of the lateral ventilating channel being closed at the inner end downstream of the outlet opening, the flushing liquid which enters into the connection region, dilutes the active-substance fluid and exits from the connection region in the outward direction as intended does not enter into the ventilation channel, or at any rate not to as pronounced an extent as was the case before. The ventilating channel is reserved for ventilation.

A preferred exemplary embodiment of the invention is explained in more detail herein below with reference to the drawing. Preferred configurations and developments of the invention are also described here.

DETAILED DESCRIPTION OF THE DRAWINGS

Figure 2:
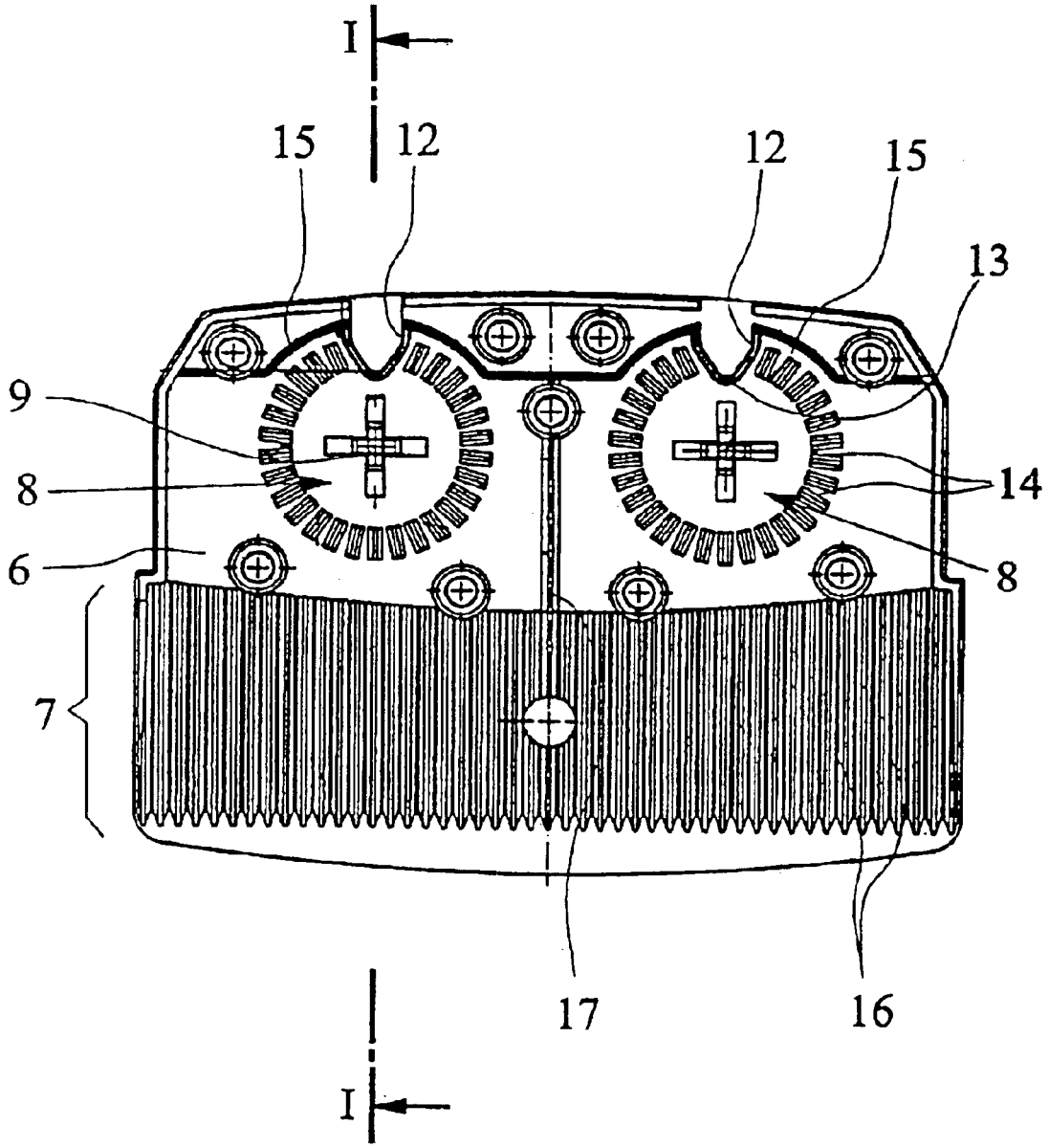
Figure 3:
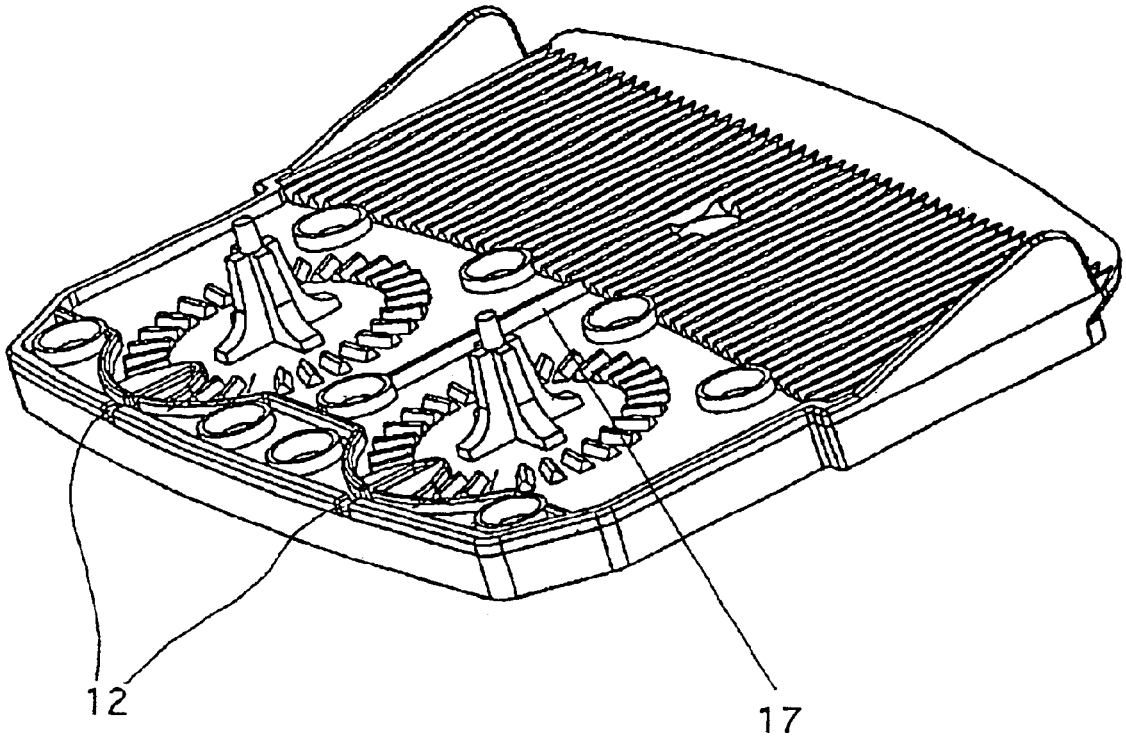

FIG. 1 shows a vertical section through a dispensing device according to the invention, FIG. 2 shows a plan view of the distributing element of the dispensing device from FIG. 1, the position of the section from FIG. 1 being depicted, and FIG. 3 shows a perspective view of the distributing element of the dispensing device from FIG. 1, this view clearly showing the arrangement of the ventilating channel.

DESCRIPTION OF THE INVENTION

The dispensing device which is illustrated in the drawing serves for dispensing an active-substance fluid into the flushing liquid with which a toilet bowl or the like is flushed. The meaning of active-substance fluid which is to be understood within the context of the teaching here has been defined in the general part of the description.

The dispensing device illustrated, in the first place, has a holder 1 which can be hung on the rim of the toilet bowl and also has a supply container 2 for an active-substance fluid provided in the holder 1. As will be explained at a later state in the text, it is likewise possible for a plurality of separate supply containers, in particular two supply containers 2 for in each case one active-substance fluid, to be provided in a holder. In this case, the active-substance fluids may be identical, different, compatible or incompatible active-substance fluids.

Examples of active-substance fluids which are suitable according to the invention are fragrance phases, in particular perfumed fragrance phases. Such fragrance phases usually contain at least one fragrance, preferably perfume oil, at least one surfactant or an emulsifier and water and possibly further contents such as preservatives, thickeners, complexing agents, dyes, further surfactants or emulsifiers, stabilizers, lime dissolvers, etc.

Likewise suitable as active-substance fluids according to the invention are bleach phases, in particular chlorine-containing bleach phases, preferably bleach phases based on hypochlorite, it usually being possible for the bleach phases to contain, in addition to the actual bleaching agent and water, possibly further contents such as thickeners, surfactants or emulsifiers, neutralizers, dyes, fragrances, etc.

Further active-substance fluids which are suitable according to the invention are lime-dissolving active-substance phases, preferably acid lime-dissolving active-substance phases. Such lime-dissolving active-substance phases may contain, in addition to the actual lime dissolver—preferably an organic or inorganic acid—and water, possibly further contents such as the surfactants or emulsifiers, thickeners, fragrances, preservatives, etc.

It is likewise possible to use highly concentrated surfactant phases, so-called "foam boosters", as active-substance fluids. Such highly concentrated surfactant phases may also contain further, conventional contents in addition to the surfactants.

Likewise suitable according to the invention are active-substance fluids with an antibacterial and/or fungicidal and/or antiviral active-ingredient phase, it being possible for the active-ingredient phase to contain, in addition to the antibacterial and/or fungicidal and/or antiviral active ingredient and water, possibly further contents such as, for example, surfactants or emulsifiers, thickeners, fragrances, preservatives, etc.

It is also possible for the active-substance fluids to be enzyme-containing active-ingredient phases. Such enzyme-containing active-ingredient phases may contain, in addition to enzyme(s) and water, possibly further contents such as surfactants or emulsifiers, thickeners, fragrances, preservatives, etc.

It is likewise possible for the active-substance fluids which are used according to the invention to be absorbent, in particular odor-absorbent, active-substance phases. In addition to the adsorbing agents, in particular odor-absorbing agents, and water, these active-substance phases may possibly contain further contents such as surfactants or emulsifiers, thickeners, fragrances, preservatives, etc.

The dispensing device according to the invention makes it possible, in accordance with a particular embodiment, to use 2 combinations of different active-substance fluids in the supply containers 2, in which case, according to a preferred embodiment, one of the supply containers 2 contains a fragrance phase, in particular as defined above.

For example for active-substance-fluid combinations which can be used are perfumed fragrance phases combined with chlorine bleach (not stable in storage together), perfumed fragrance phase with highly concentrated surfactant phase (foam booster), fragrance phase with lime-dissolving, acid active-substance phase, fragrance phase with antibacterial active-substance phase, different acid systems, fragrance phase combined with enzyme-containing active-substance phase, perfumed acid phase combined with water-coloring phase, fragrance phase with odor-adsorbent phase, perfumed acid phase with active oxygen, perfumed acid phase with active-substance phase, thickened with polyacrylate, etc.

Viscous to gel-like active-substance fluids with viscosities in the range of a few thousand mPas, in particular of 2000 to 5000 mPas, preferably 2500 to 3500 mPas (measured with a Rotovisko LVT rotary viscometer, spindle 2, 6 rpm, 20° C.) are of particular interest here.

FIG. 1 shows that the supply container 2 has an outlet-side border 3 and an outlet opening 4 via which the active-substance fluid can be dispensed into the flushing liquid. The exemplary embodiment which is illustrated and, to this extent, preferred, although it is not imperative, also shows that the outlet opening 4 is arranged here in a cover 5 forming the border 3. The outlet opening 4 is formed in the cover 5, in turn, by an outlet border 3' which is offset inward in relation to the border 3 on the cover 5.

The exemplary embodiment illustrated provides an exchangeable supply container 2, of which the outlet opening 4 is firmly closed, in the first instance, by a stopper 5'. By virtue of the supply container 2 being inserted into the holder 1, the stopper 5', as can be seen in FIG. 1, is pushed upward, out of the outlet opening 4, into the interior of the supply container 2, with the result that the outlet opening 4 is then open. Using a cover 5 with the stopper 5' fixed therein, with initial closing action, via a predetermined breaking point is expedient in production terms. It is indeed desired for the supply container 2 to be filled quickly by way of a large opening, but, thereafter, the intention is for the outlet opening 4 to be arranged and configured in accordance with quite different viewpoints. Moreover, the stopper 5' is used as a lost element, in order to make it possible for the supply container 2 simply to be plugged on with the outlet opening 4 directed downward.

A plate-like distributing element 6 is provided on the holder 1, that having, on the one hand, a region of action 7 over which flushing liquid flows during the flushing operation and, on the other hand, a connection region 8, in which a point of connection 9 for the outlet opening 4 of the supply container 2 is arranged. This can easily be understood in FIG. 2 taken together with FIG. 1.

The interior of the supply container 2 is connected permanently to the distributing element 6 via the outlet opening 4, to be precise, in the exemplary embodiment illustrated, with the interposition of an arrangement which prevents free flow of the active-substance fluid and, in the exemplary embodiment which is illustrated and preferred, has an opening spike at the point of connection 9. In order to realize this, the border 3—when the supply container 2 is fitted on the holder 1—is spaced apart by a small distance from the surface of the distributing element 6.

By virtue of the arrangement explained above, the supply container 2 is protected against the ingress of flushing liquid into its interior and the outlet opening 4 of the supply container 2 is arranged such that essentially only active-substance fluid passes out and, for replacement of the active-substance fluid in the supply container 2, air enters into the interior of the supply container 2. During each flushing operation, some of the active-substance fluid is dispensed from the supply container 2 into the flushing liquid.

For the arrangement and fitting method of the supply container 2, reference may also be made to the prior art explained in the introduction. You are also referred to a utility model DE 201 16 963 U, which is published after the priority date and is attributed to the applicant.

The dispensing device which is illustrated in FIG. 1 also shows that, in the case of this embodiment, the holder 1 has a carrier 10 which accommodates the supply container 2, a front wall 11 directed toward the region of action 7 running along the transition from the connection region 8 to the region of action 7. The front wall 11 of the holder 1 serves for shielding the supply container 2 against undesirable ingress of water from this side. The negative consequences of undesirable ingress of water into the supply container 2 are known, explained above and also form the subject matter of extensive analyses in the prior art.

The exemplary embodiment of the dispensing device which is illustrated in the drawing, then, shows that arranged on the top side of the distributing element 6, on that side of the point of connection 9 which is directed away from the region of action 7, is a ventilating channel 12 which extends through beneath the border 3 from the border of the distributing element 6 and is open on the top side. The ventilating channel 12 serves for the specific supply of air, already mentioned above, from the outside into the interior of the supply container 2, in order to optimize the drainage characteristics of the active-substance fluid.

The exemplary embodiment illustrated, then, is distinguished, as is shown to good effect, in particular, by the detail in FIG. 1, that the ventilating channel 12 has its border closed at the inner end. In other words, the ventilating channel 12 is open, on the one hand, in the direction away from the outlet opening 4 and, on the other hand, in the upward direction. On account of the position of the border 3 of the supply container 2 in relation to the distributing element 6 in the connection region 8, this means that the ventilating channel 12 forms an upwardly directed air-exit opening in relation to the outlet opening 4. This results in the advantageous effects in respect of the air/active-substance fluid exchange which are explained in the general part of the description.

The ventilating channel 12 can be configured in different ways in the distributing element 6, and this ventilating channel 12 can also be provided in different forms. As far as the cross section is concerned, a V-shaped, a U-shaped or even a channel formed with a plurality of tracks may prove to be expedient here. The ventilating channel 12 can be incorporated in the material of the distributing element 6, in the connection region 8. This gives rise to the already mentioned advantage of the air being deflected upward. Moreover, a direct lateral inflow of flushing liquid is prevented. The exemplary embodiment which is illustrated and preferred is also distinguished in that the ventilating channel 12 is closed at the inner end by means of a channel border 13 projecting upward from the top side of the distributing element 6. It is precisely the enlarged illustration of FIG. 1 which shows, in section, the channel border 13, which terminates the ventilating channel 12 on the inside. By means of the channel border 13 projecting up from the surface of the distributing element 6, the mixture of flushing liquid and active-substance fluid is prevented particularly effectively from entering into the ventilating channel 12.

The cross-sectional shape of the ventilating channel 12 has already been explained to some extent. In the exemplary embodiment illustrated, the ventilating channel 12 is simply of smooth configuration on the base side. However, as FIG. 2 shows, it is provided, in the exemplary embodiment illustrated, that the closed end of the ventilating channel 12 is tapered in a V-shaped manner, in this case with a certain amount of rounding, or a U-shaped manner. This results in a broad ventilating channel 12 which allows easy inflow of air from the outside, but nevertheless realizes a defined, small air-passage cross section in the connection region 8. This air-passage cross section can expediently be coordinated with the viscosity and the other qualities of the active-substance fluid which is located, or is to be accommodated, in the supply container 2, in order to guarantee the desired functioning. FIG. 3 shows a perspective view of the position and width of the ventilating channels 12.

In specific terms, it is realized in the exemplary embodiment that the arrangement which prevents the free flow of the active-substance fluid has a spacer arrangement with spacers 14 which project slightly upward from the top side of the distributing element 6 and on which the border 3 of the supply container 2 stands. The previously explained ventilating channel 12, then, interrupts this spacer arrangement or is arranged between two spacers 14 of this spacer arrangement.

For the functioning of the dispensing device according to the invention, it has proven to be expedient in tests, for certain viscosities, if the spacers 14 and the channel border 13 of the ventilating channel 12 project upward from the top side of the distributing element 6 by the same extent. The border 3 of the supply container 2 then rests both on the spacers 14 and on the channel border 13. It is only the innermost upwardly open end of the ventilating channel 12 which then produces the air-access cross section in a defined manner.

In specific terms, if use is made of active-substance fluids of average viscosity, it has proven to be expedient for the spacers 14 to project upward from the top side of the distributing element 6 by approximately 0.7 mm. The exemplary embodiment which is illustrated and preferred here, at the same time, shows that the channel border 13 projects upward from the top side of the distributing element 6 by approximately 0.7 mm.

In further tests with other viscosities, it has also proven to be expedient, in an alternative, to allow the channel border 13 to project upward from the top side of the distributing element 6 by a greater extent than the spacers 14, that is to say for example, with spacers 14 of 0.7 mm, by 0.9 mm. The channel border 13 thus projects into the inner region of the cover 5 within the border 3 and constitutes an even more effective barrier for the active-substance fluid and flushing liquid mixture within the spacer arrangement.

Reference has already been made above to the fact that the supply container 2 should be protected as far as possible against the ingress of flushing liquid into its interior. For this purpose, it is also provided in the exemplary embodiment that formed in the connection region 8, on that side on the point of connection 9 which is directed toward a longitudinal border, enclosing the spacers 14 on this side, is a protective border 15 which projects slightly upward from the top side of the distributing element 6. The exemplary embodiment which is illustrated and preferred here shows that this protective border 15 projects somewhat further upward than the channel border 13 and the spacers 14, namely by in this case 0.9 mm.

It has previously been explained in specific terms that the inner opening of the ventilating channel 12 is important. In specific terms, it may prove to be expedient here, although this is, of course, dependent on the viscosity range in which the active-substance fluid is found, that the free cross section of the overlapping region of the ventilating channel 12 within the border 3, in the longitudinal direction of the ventilating channel 12, has a dimension of approximately 0.6 to 1.5 mm, preferably of approximately 1.0 mm. A further determinant for the ventilating channel 12 is preferably a maximum width of 1.0 to 5.0 mm, preferably of approximately 2.5 mm. This gives rise to access of air being easily possible, as has been explained above.

In order to maintain the balance between access of air and preventing active-substance fluid and/or flushing liquid from passing out into the ventilating channel 12, and thus blocking the ventilating channel 12, it is recommended, in the case of active-substance fluids of average viscosity, that the ventilating channel 12, on the inner periphery of the border 3, has a width of approximately 0.5 to 2.5 mm, preferably of approximately 1.0 to 1.5 mm. The preferred dimensions specified above result in a free cross section at the end of the ventilating channel 12, for the passage of air, of 0.2 to 2.2 $mm^2$, preferably of 0.5 to 1.0 $mm^2$.

The exemplary embodiment which is illustrated and, to this extent, preferred also shows that there is a smooth-surfaced strip of the connection region 8 between the outer border of the point of connection 9 and the region of action 7.

Reference has already been made above to the fact that the dispensing device described is suitable particularly for dispensing a plurality of, in particular, two, active-substance fluids from a plurality of, in particular two, supply containers 2 to a distributing element 6. FIG. 2 shows, in this respect, a distributing element 6 for two supply containers 2, which are not themselves illustrated. In the case of this embodiment of the dispensing device, it is provided that the holder 1 contains at least two supply containers 2 for in each case one active-substance fluid. The two supply containers 2 are correspondingly protected against the ingress of flushing liquid into their interior, and the two outlet openings 4 of the supply containers 2 are arranged such that only active-substance fluid passes out and, as far as possible, only ventilating air enters in again. The outlet openings 4 of the two supply containers 2 are arranged on the base side, in the used position which can be gathered from FIG. 1. In the exemplary embodiment which is illustrated and preferred, the supply containers 2 are fitted in an individually exchangeable manner in the holder.

For the configuration of this multiple dispensing device, reference may also be made to the previously explained prior art DE 201 16 963 U, which was not published before the priority data and the disclosure contents of which are also made part of the disclosure contents of the present patent application by reference.

FIG. 2 clearly shows that the plate-like distributing element 6 is provided jointly for both supply containers 2, and, in the presence of a plurality of supply containers 2, for all the supply containers 2, that the distributing element 6 has the points of connection 9 for the outlet openings 4 of the supply containers 2 spaced apart one beside the other in the connection region 8, and that each point of connection 10 is assigned a dedicated ventilating channel 12.

Finally, it can be seen from FIGS. 1 and 2 together that the distributing element 6 in the region of action 7, has depressions 16 extending from the border of the connection region 8 approximately as far as the opposite longitudinal border, the depressions serving for distributing the active-substance fluid or the active-substance fluids into the flushing liquid. In the exemplary embodiment illustrated, the depressions 16 extend to just beneath the border of the front wall 11. In the exemplary embodiment illustrated, and in accordance with preferred teaching, it is provided here that only a small gap, preferably a gap of 0.1 to 0.4 mm, in particular a gap of approximately 0.2 to 0.3 mm, is present between the uppermost border of the depressions 16 in the region of action 7 and the border of the front wall 11 of the carrier 10.

FIG. 1 clearly shows the position of the front wall 11 of the holder 1 in relation to the depressions 16 in the region of action 7 of the distributing element 6. FIG. 1 also clearly shows that, in the exemplary embodiment illustrated here, the carrier 10, rather than being an integral constituent part of the holder 1, is a separate insert part which is inserted into the holder 1. The front wall 11 here is formed on the holder 1. If the carrier 10 is an integral constituent part of the holder 1, then the front wall 11 is formed on the holder 1.

The exemplary embodiment which is illustrated also shows, in FIG. 1, that the top side of the distributing element 6, in the connection region 8, runs level with the lowermost point of the depressions 16 in the region of action 7. The active-substance fluid can thus enter into the depressions 16 on the end side. At the same time, the possibility of water to gain access beneath the border of the front wall 11 is restricted as much as possible. It can also be seen in FIG. 1 that there is a considerable vertical distance between the underside of the holder 1 and the surface of the distributing element 6 in the connection region 8, in the free regions.

Finally, FIG. 2 also shows that, as has already been explained, the top side of the distributing element 6 is smooth for the active-substance fluid in the connection region 8, but otherwise, for reasons related to fastening, connection and sealing, may have individual elevations.

Finally, reference may also be made once again to the preferred viscosity ranges for the active-substance fluid which have already been mentioned in the specific part of the description. These are particularly expedient to realize.

Furthermore, FIGS. 2 and 3 clearly show that a central border 17 which projects slightly upward from the top side of the distributing element 6 is realized here, this central border, in the exemplary embodiment illustrated, ensuring that the active-substance fluids of the two supply containers 2, which may not be compatible with one another here, can only mix together in the region of action 7, with the addition of flushing liquid. Furthermore, there are a large number of further variants here for compatible and incompatible active-substance fluids, for which purpose reference may likewise be made once again to DE 201 16 963 U, which was not published before the priority date.

As used herein, the articles "a" and "an" are synonymous and used interchangeably with at least one "one or more," disclosing or encompassing both the singular and the plural, unless specifically defined otherwise. The conjunction "or" is used herein in its inclusive disjunctive sense, such that phrases formed by terms conjoined by "or" disclose or encompass each term alone as well as any combination of terms so conjoined, unless specifically defined otherwise. All numerical quantities are understood to be modified by the word "about," unless specifically modified otherwise or unless an exact amount is needed to define the invention over the prior art.

What is claimed is:

1. A dispensing device for dispensing an active-substance fluid into the flushing liquid in a toilet bowl, comprising a supply container (2) for an active-substance fluid, the supply container (2) having an outlet-side border (3) and an outlet opening (4) via which the active-substance fluid can be dispensed into the flushing liquid, the dispensing device further comprising a plate-shaped distributing element (6), the distribution element having a region of action (7) over which flushing liquid flows during flushing and a connection region (8), in which a point of connection (9) for the outlet opening (4) of the supply container (2) is arranged, wherein the interior of the supply container (2) is connected permanently to the distributing element (6) via the outlet opening (4), and the border (3) is spaced apart by a small distance from the surface of the distributing element (6), wherein arranged on the top side of the distributing element (6), on a side of the point of connection (9) that is directed away from the region of action (7), is a ventilating channel (12) that extends through beneath the border (3) from the longitudinal border of the distributing element (6) and is open on the top side, and wherein the ventilating channel (12) has its border closed at the inner end, wherein the ventilating channel (12) is closed at the inner end by a channel border (13) projecting upwardly from the top side of the distributing element (6), wherein the interior of the supply container (2) is connected to the distributing element (6) via the outlet opening (4), wherein a means to impede free flow of the active-substance fluid is provided downstream of the interior of the supply container (2), wherein the means to impede free flow of the active-substance fluid has a spacer arrangement with spacers (14) that project upwardly from the top side of the distributing element (6) and on which the border (3) of the supply container (2) stands, and wherein the ventilating channel (12) abuts the spacer arrangement or is located between two spacers (14) of the spacer arrangement.

2. The dispensing device of claim 1, wherein the outlet opening (4) is arranged in a cover (5) forming the border (3) and is formed in this cover by an outlet border (3') that is offset inward in relation to the border (3).

3. The dispensing device of claim 2, wherein the outlet border (3') of the outlet opening (4) in the cover (5) is spaced apart from the top side of the distributing element (6) by a greater distance than the border (3) formed by the cover (5).

4. The dispensing device of claim 3, wherein the outlet border (3') of the outlet opening (4) in the cover (5) is spaced apart from the top side of the distributing element (6) by approximately 0.5 mm more than the border (3) formed by the cover (5).

5. The dispensing device of claim 1, comprises an opening spike at the point of connection (9).

6. The dispensing device of claim 1, wherein the closed end of the ventilating channel (12) tapers in a V-shape or U-shape.

7. The dispensing device of claim 1, wherein the spacers (14) and the channel border (13) of the ventilating channel (12) project upward from the top side of the distributing element (6) to the same extent.

8. The dispensing device of claim 1, wherein the spacers (14) project upward from the top side of the distributing element (6) by approximately 0.7 mm.

9. The dispensing device of claim 1, wherein the channel border (13) projects upward from the top side of the distributing element (6) by approximately 0.7 mm.

10. The dispensing device of claim 1, wherein the channel border (13) projects upward from the top side of the distributing element (6) by a greater extent than the spacers (14).

11. The dispensing device of claim 10, wherein the spacers (14) project upward from the top side of the distributing element (6) by approximately 0.7 mm, and the channel border (13) projects upward from the top side of the distributing element (6) by approximately 0.9 mm.

12. The dispensing device of claim 1, wherein formed in the connection region (8), on a side of the point of connection (9) that directed toward a longitudinal border, is a protective border (15) that projects slightly upward from the top side of the distributing element (6).

13. The dispensing device of claim 12, wherein the protective border (15) projects upward from the top side of the distributing element (6) by approximately 0.9 mm.

14. The dispensing device of claim 1, wherein the ventilating channel (12) within the border (3) has a length of approximately 0.6 to 1.5 mm.

15. The dispensing device of claim 14, wherein the ventilating channel (12) has a length of 1.0 mm.

16. The dispensing device of claim 1, wherein the ventilating channel (12) has a maximum width of 1.0 to 5.0 mm.

17. The dispensing device of claim 16, wherein the ventilating channel (12) has a maximum width of 2.5 mm.

18. The dispensing device of claim 17, wherein the ventilating channel (12) has a width of approximately 1.0 to 1.5 mm.

19. The dispensing device of claim 1, wherein the ventilating channel (12) has a width of approximately 0.5 to 2.5 mm.

20. The dispensing device of claim 1, wherein the ventilating channel (12) within the border (3) has a cross-sectional surface area of approximately 0.2 to 2.2 $mm^2$.

21. The dispensing device of claim 20, wherein the ventilating channel (12) within the border (3) has a cross-sectional surface area of approximately 0.5 to 1.0 $mm^2$.

22. The dispensing device of claim 1, comprising a smooth-surfaced strip of the connection region (8) between the outer border of the point of connection (9) and the region of action (7).

23. The dispensing device of claim 1, further comprising a holder (1) containing at least two separate supply containers (2), each supply container (2) having a dedicated outlet opening (4) via which its content can be dispensed into the flushing liquid, wherein the plate-shaped distributing element (6) is provided jointly for at least two of the supply containers (2), wherein the plate-shaped distributing element (6) has points of connection (9) for the outlet openings (4) of the supply containers (2) spaced apart one beside the other in the connection region (8), in the vicinity of the longitudinal border, and wherein each point of connection (9) has assigned a dedicated ventilating channel (12).

24. The dispensing device of claim 1, wherein the distributing element (6), in the region of action (7), has depressions (16) extending from the border of the connection region (8) approximately as far as the opposite longitudinal border, these depressions serving for distributing the active-substance fluid or the active-substance fluids into the flushing liquid.

25. The dispensing device of claim 24, wherein the depressions (16) in the region of action (7) extend to just beneath the border of the front wall (11).

26. The dispensing device of claim 1, further comprising a holder (1) having a carrier (10) that accommodates the supply container or supply containers (2), a front wall (11) directed toward the region of action (7) running along the transition from the connection region (8) to the region of action (7).

27. The dispensing device of claim 26, wherein a small gap is present between the uppermost border of the depressions (16) in the region of action (7) and the border of the front wall (11) of the carrier (10).

28. The dispensing device of claim 27, wherein the gap is approximately 0.1 to 0.4 mm wide.

29. The dispensing device of claim 28, wherein the gap is approximately 0.2 to 0.3 mm wide.

30. The dispensing device of claim 1, further comprising one or more active-substance fluids accommodated in the supply containers (2) and having viscosities of 2000 to 5000 mPas.

31. The dispensing device of claim 30, wherein the active-substance fluids have viscosities of 2500 to 3500 mpas.

* * * * *